United States Patent [19]

Kawano et al.

[11] Patent Number: 4,502,057

[45] Date of Patent: Feb. 26, 1985

[54] METHOD AND APPARATUS FOR DETECTING ERRORS IN AN INK RIBBON IN A THERMAL TRANSFER TYPE MULTICOLOR PRINTER

[75] Inventors: Junji Kawano; Fumio Takahashi, both of Ise, Japan

[73] Assignee: Shinko Electric Co., Ltd., Tokyo, Japan

[21] Appl. No.: 526,874

[22] Filed: Aug. 26, 1983

[30] Foreign Application Priority Data

Aug. 30, 1982 [JP] Japan ..... 57-151086

[51] Int. Cl.[3] ..... B41J 3/20

[52] U.S. Cl. ..... 346/76 PH; 400/120; 400/240.3; 400/249; 346/106

[58] Field of Search ..... 346/76 PH, 106, 107; 219/216 PA; 400/120, 219, 244, 240.3, 249; 358/76

[56] References Cited

U.S. PATENT DOCUMENTS 4,091,913 5/1978 Ku et al. ..... 400/249

FOREIGN PATENT DOCUMENTS 2100673 4/1982 United Kingdom ..... 400/120

*Primary Examiner*—E. A. Goldberg

*Assistant Examiner*—A. Evans

*Attorney, Agent, or Firm*—Cushman, Darby & Cushman

[57] ABSTRACT

A method and apparatus for detecting an error such as a cutoff or the like of an ink ribbon used in a thermal transfer type multicolor printer, wherein the ink ribbon is provided with sets of ink zones containing heat dissolving inks, each set of the ink zones including ink zones, disposed in a predetermined order, of different colors. A timer is preset for providing an electric signal representative of detection of the error at an end of a predetermined timing interval equal to a time period necessary in an ink detection mode, in which one of the ink zones having a specified color is detected, for passing at least one ink zone through a printing position where a multicolor printing is made by means of a thermal head. The ink ribbon is then wound at a predetermined speed in the ink detection mode, and the timer is set at the winding of the ink ribbon. A sensor mark, which is provided to each of the ink zones for indicating its color, is detected to provide a color signal representative of the color indicated by the sensor mark. The timer is reset according to the color signal. The error detection signal is provided when the timer become operative because no color signal is supplied to the timer within the timing interval.

3 Claims, 4 Drawing Figures

METHOD AND APPARATUS FOR DETECTING ERRORS IN AN INK RIBBON IN A THERMAL TRANSFER TYPE MULTICOLOR PRINTER

BACKGROUND OF THE INVENTION

The present invention relates to a method and apparatus for detecting errors such as a cutoff and the like of an ink ribbon used in thermal transfer type multicolor printers.

With the wide use of color cathode ray tubes (CRT) in the display of personal computers and CAD systems, there has been a strong need for a printer which provides multicolor hardcopies of pictures on color CRT. In order to meet such a need, there has been proposed a thermal transfer type multicolor printer in a copending U.S. patent application Ser. No. 511,630 entitled "Method of making thermal transfer type multicolor printing," filed on July 7, 1983 and assigned to the assignee of the present application.

In the prior art thermal transfer type printers including monocolor printers, there has been used, for example, a precision snap-acting switch for detecting a cutoff of an ink film which is normally in contact with the actuator of the sensitive switch. Since the ink film is thin, time is required to set it on the actuator of the switch. Furthermore, the ink film can be scratched by the actuator. In order to avoid these drawbacks, there has been used a photosensor only for the purpose of detecting a cutoff of an ink ribbon by projecting a light beam onto that ribbon. However the use of such an exclusive photosensor is disadvantageous in cost.

SUMMARY OF THE INVENTION

Accordingly, it is an object of the present invention to provide a method and apparatus for detecting errors in a color ribbon used in a thermal transfer type multicolor printer, which do not require any exclusive sensor for detecting errors such as a cutoff and the like of the ink ribbon, and are hence advantageous in cost.

It is another object of the present invention to provide a method and apparatus for detecting errors in an ink ribbon used in a thermal transfer type multicolor printer, in which the ink ribbon is easily set to the printer without producing any damage such as scratches in the ink ribbon.

With these and other objects in view the present invention provides a method of detecting an error such as a cutoff or the like of an ink ribbon used in a thermal transfer type multicolor printer, wherein the ink ribbon is provided with sets of ink zones containing heat dissolving inks, each set of the ink zones including ink zones, disposed in a predetermined order, of different colors. A timer is preset for providing an electric signal representative of detection of the error at an end of a predetermined timing interval equal to a time period necessary in an ink detection mode, in which one of the ink zones having a specified color is detected, for passing at least one ink zone through a printing position where a multicolor printing is made by means of a thermal head. The ink ribbon is then wound at a predetermined speed in the ink detection mode, and the timer is set at the winding of the ink ribbon. A sensor mark, which is provided to each of the ink zones for indicating its color, is detected to provide a color signal representative of the color indicated by the sensor mark. The timer is reset according to the color signal. The error detection signal is provided when the timer become operative because no color signal is supplied to the timer within the timing interval.

Another aspect of the present invention is directed to an apparatus for detecting an error such as a cutoff or the like of an ink ribbon used in a thermal transfer type multicolor printer wherein: the ink ribbon is provided with sets of ink zones containing heat dissolving inks, each set of the ink zones including ink zones, disposed in a predetermined order, of different colors; and the ink ribbon is fed at a predetermined speed in an ink detection mode, in which one of the ink zones having a specified color is detected, by a ribbon winding motor, the motor rotating a ribbon winding reel on which the ink ribbon is wound, comprising:

(a) a sensor mark, provided to each of the ink zones, for indicating a color of each of the ink zones;

(b) a detector for detecting the sensor mark provided to one of the ink zones for providing a signal representative of the sensor mark, the one ink zone being in the printing position;

(c) means, electrically connected to the detector, for identifying the color of the one ink zone according to the sensor mark signal supplied from the detector and for supplying a color signal representative of the one ink zone of the color being in the printing position;

(d) means for controlling the ribbon winding motor and providing an electric signal representative of the winding of the ribbon at the energization of the ribbon winding motor; and (e) a timer, connected to the color identifying means and the control means, and presetable for providing an electric signal representative of detection of the error at an end of a predetermined timing interval equal to a time period necessary for feeding at least one ink zone, the timer being adapted to be reset according to the ribbon winding signal and the color signal.

BRIEF DESCRIPTION OF THE DRAWINGS

While the specification concludes with claims which particularly point out and distinctly define the subject matter which is regarded as the invention, it is believed the invention will be more clearly understood from the following detailed description and the accompanying drawings, in which:

DETAILED DESCRIPTION OF THE PREFERRED EMBODIMENTS

Figure 1:
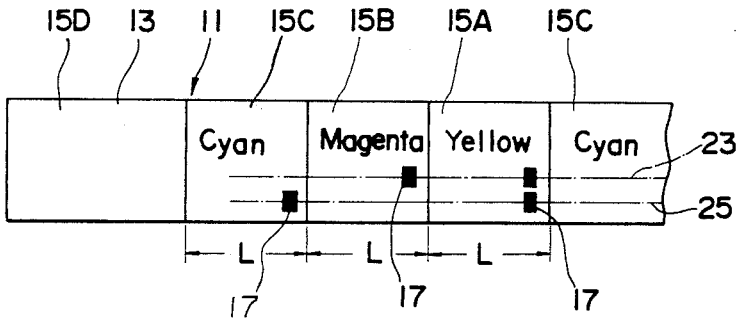
FIG. 1 is a plan view illustrating an ink transfer ribbon used in the present invention.

Referring to FIG. 1, there is illustrated an ink transfer ribbon 11 adopted in the present invention. The ribbon 11 includes a base tape 13 made of a transparent or semitransparent film such as a condenser paper, polyester film or the like, on which a great number of yellow ink zones 15A, magenta ink zones 15B and cyan ink zones 15C of the same length L are formed. These ink zones 15A, 15B and 15C are respectively formed by applying well-known heat-dissolving light-reflective yellow, magenta and cyan inks over one face of the base 13. Each color ink appears every three ink zones 15, and thereby ribbon 11 carries a great number of ink zone sets, each set consisting of three ink zones, i.e., yellow, magenta and cyan ink zones 15A, 15B and 15C. Each ink zone 15 is provided at its border adjacent to the immediately preceding ink zone 15A, 15B or 15C with a sensor mark or sensor marks 17 which may be a through hole, metal piece, etc., and which are selected according to the kind of a sensor used for sensing those sensor marks. In this embodiment, first and second photosensors 19 and 21 of a well-known light reflective type are used (see FIG. 2), and one or two square sensor marks 17 of a light absorbent black ink are applied on each of the ink zones along either one or both of the sensing tracks 23 and 25 of first and second photosensors 19 and 21. Yellow ink zones 15A have each two square sensor marks 17 and 17 disposed on two sensing tracks 23 and 25, magenta ink zones 15B one sensor mark 17 disposed on first sensing track 23, and cyan ink zone 15C one sensor mark 17 disposed on second sensing track 25. The ink ribbon 11 is provided at its end with a translucent end portion 15D since no ink is applied over that portion. However, any light reflective material may be applied or adhered to the end portion 15D of the ink ribbon 11.

Figure 3:
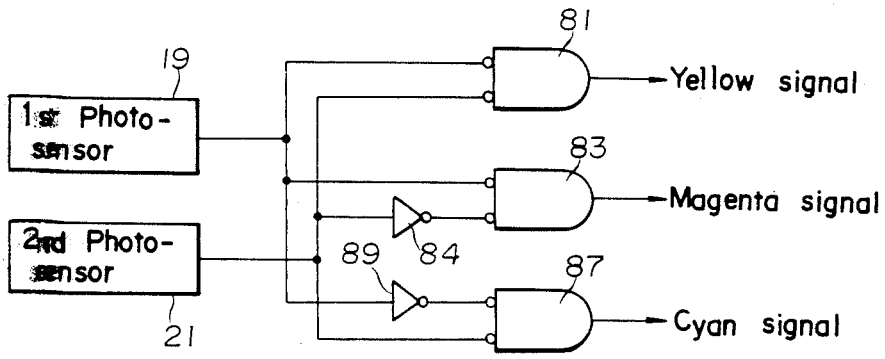
FIG. 3 is a block diagram showing a color identifying circuit adopted in the present invention.
Figure 2:
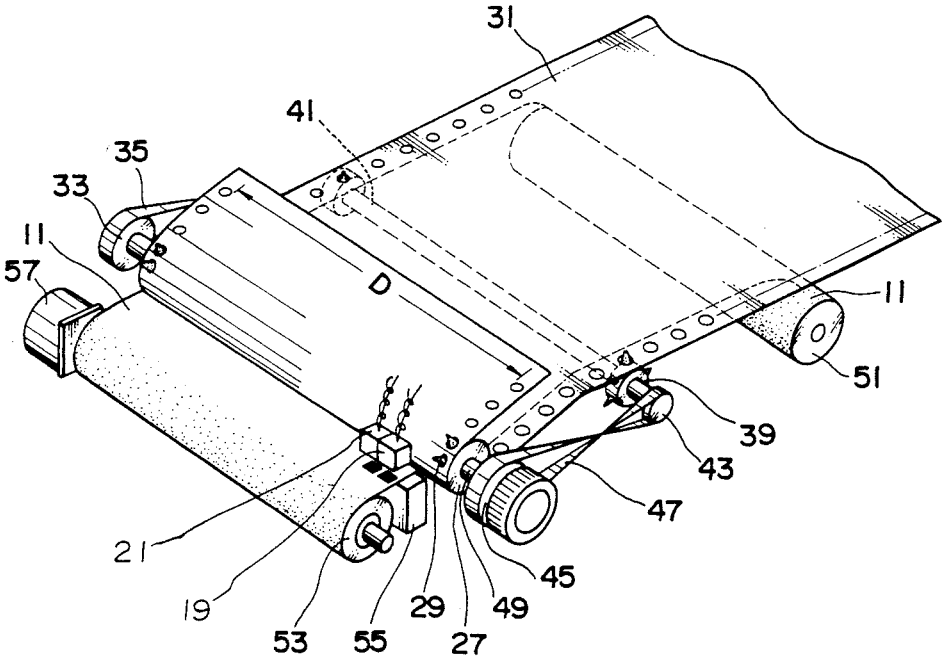
FIG. 2 is a perspective view illustrating a thermal transfer type multicolor printer using the ink transfer ribbon in FIG. 1.
Figure 4:
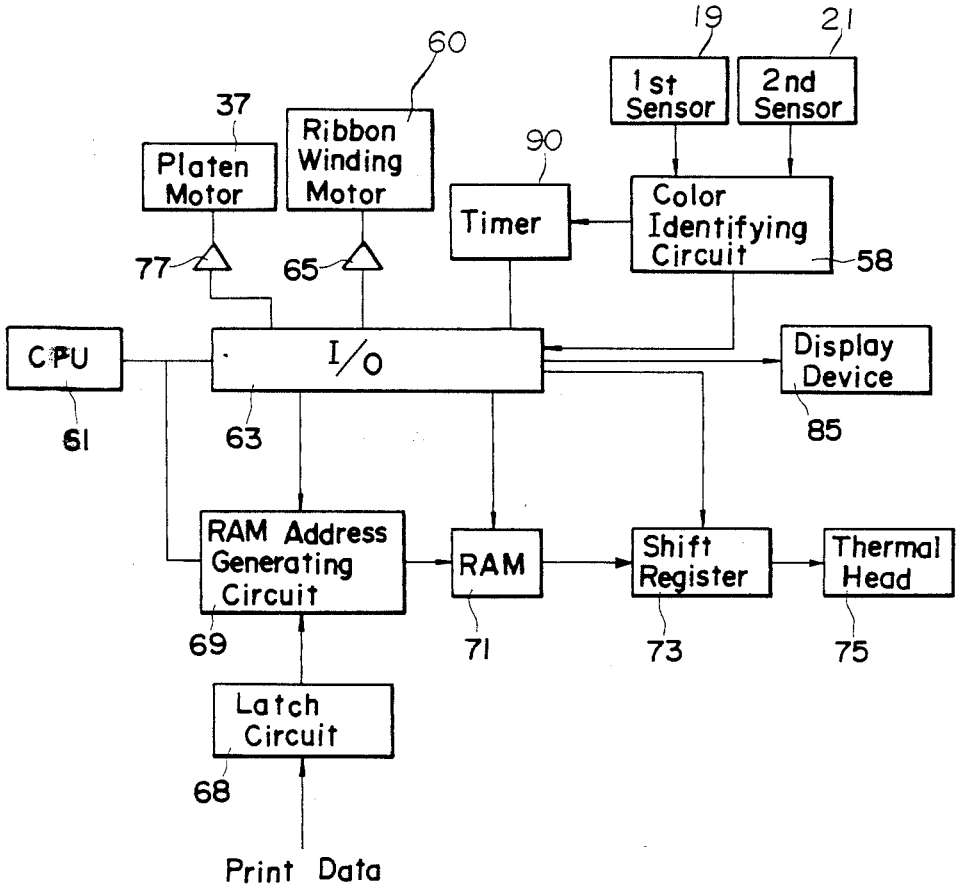
FIG. 4 is a block diagram illustrating a control unit of the printer in FIG. 2.

FIG. 2 illustrates a thermal transfer type multicolor printer in which the above-described ink ribbon 11 is used. In the printer, the reference numeral 27 indicates a platen roller having sprocket pins 29 mounted on the opposite edges thereof so as to engage with feed holes formed in the opposite edges of a fanfold paper 31. The platen roller 27 is rotatably supported on a frame (not shown for illustration purpose), and is rotated by a stepper motor 37 as a platen motor (FIG. 4) through a transmission gear including a timing belt 35 and timing pulleys 33 only one of which is shown. On the rear side of platen roller 27 there is disposed a pair of sprocket wheels 39 and 39, which are mounted on a shaft 41, so as to engage with the feed holes of the fanfold paper 31. On one end of shaft 41 there is mounted a timing pulley 43, which is connected to another timing pulley 45 by means of a crossed timing belt 47, the timing pulley 45 being mounted on one end of a shaft 49 of platen 27. The fanfold paper 31, which is stocked in a folded condition in a paper container (not shown), is supplied from it, and is then placed over platten 27. On the rear side of sprocket wheels 39 and 39 there is provided an ink ribbon supply reel 51 which is rotatably supported on the frame, and which has the ink transfer ribbon 11 wound around it. The ink transfer ribbon 11, which is smaller in width than the distance D between the opposite feed holes of the fanfold paper 31, extends from ribbon supply reel 51, engages with platen roller 27 with fanfold paper 31 interposed between them, and is then wound around a ribbon winding reel 53. This ribbon winding reel 53 is rotatably supported on the frame on the front side of platen roller 27 and is connected to a ribbon winding reel drive unit 57 including a slip friction clutch and an electric motor 60 (FIG. 3). A thermal head 55 is provided between platen roller 27 and ribbon winding reel 53 so as to be movable towards and away from the platen roller 27 in a well-known manner. On the front side of the platen roller 27 and above ribbon winding reel 53 there is provided a pair of light reflective type photosensors 19 and 21 adjacent to platen roller 27. The photosensors 19 and 21 are disposed side by side so as to sense sensor marks 17.

In operation, after a print start switch (not shown) is activated, photosensors 19 and 21 detect sensor marks 17 of ink ribbon 11 in an ink detection mode described below. When two sensor marks 17 and 17 of yellow ink zone 15A are at first and second detection positions which are just below photosensors 19 and 21 respectively, a starting portion adjacent to those marks of that yellow ink zone is located in a printing position over platen 27, and light beams emitted from those photosensors 19 and 21 are absorbed by the two sensor marks 17 and 17, and hence the photosensors 19 and 21 apply low signals to NOR gate 81, shown in FIG. 3, of a color identifying circuit 58, which includes NOR gates 81, 83 and 87. The NOR gate 81 thus provides a yellow signal representative of yellow ink zone 15A being in the printing position to a central processing unit (CPU) 61 in FIG. 4 through an input-output interface (I/O) 63. When sensor mark 17 of magenta ink zone 15B is at the first detection position below the first photosensor 19, it absorbs a beam emitted from that photosensor 19, which hence applies a low signal to NOR gate 83. On the other hand, another beam emitted from the second photosensor 21 is reflected at the surface of magenta ink zone 15B towards that photosensor 21, with the result that the photosensor 21 applies a low signal through an inverter 84 to NOR gate 83, which thus provides a magenta signal, representing that a starting portion of magenta ink zone 15B is in the printing position, to CPU 61 through I/O 63. When sensor mark 17 of cyan ink zone 15C is at the second detection position below second photosensor 21, a beam from that photosensor is absorbed by that senso mark 17, which causes photosensor 21 to apply a low signal to a NOR gate 87. On the other hand, another beam from first photosensor 19 is reflected from that cyan ink zone 15C, with the result that photosensor 19 applies a low signal through an invertor 89 to NOR gate 87, which thus provides a cyan signal, representing that a starting portion of cyan ink zone 15C is in the printing position, to CPU 61 through I/O 63. In CPU 61, comparison is made according to the thus provided color signal concerning the ink zones 15A, 15B and 15C as to whether or not the color of the detected ink zone agrees with a specified color of which data are previously input into CPU 61. When the result is negative, CPU 61 sends an instruction to a driver 65 to drive ribbon winding motor 60 so as to rotate ribbon winding reel 53 to wind ink ribbon 11 around it at a predetermined speed until the color of the detected ink zone agrees with the specified color.

Subsequently, print data are input through a latch circuit 68 into a random-access memory (RAM) address generating circuit 69, which then writes the input print data in a RAM 71. The thus written print data are read by RAM address generating circuit 69 and transferred to a shift register 73. After the transference of the print data, CPU 61 provides gates (not shown) with pulses to gate the print data from shift register 73 to heat generating elements incorporated into a thermal head 75 so as to drive those elements, with the result that the heat-dissolving ink of the specified ink zone is heated and molten by the driven heat generating elements, and is thereby transferred to a start portion of fanfold paper 31 in the printing position. By these procedures printing for one dot line is performed, after which CPU 61 drives platen motor 37 and ribbon winding motor 60 by means of a platen motor driver 77 and ribbon motor driver 65, respectively, to feed fanfold paper 31 and ribbon 11 for printing of a subsequent line. In such a manner, a picture component, for the specified color, of a picture to be reproduced is printed on fanfold paper 31.

Assuming that the printing of a yellow picture component by the use of a yellow ink zone 15A is completed and that the subsequently specified color is cyan, the start portion of fanfold paper 31 is returned to the printing position, and ink ribbon 11 is fed until sensor mark 17 of a subsequent cyan ink zone 15c is detected by the second photosensor 21, in which ink detection mode a magneta ink zone 15B which immediately follows the yellow ink zone 15A passes through the printing position without being subjected to the printing operation. Then, the cyan ink of cyan ink zone 15C is transferred to fanfold paper 31 in a manner similar to the above-described manner. In this way, multicolor printing is carried out.

Before the above-described printing, timer 90 (FIG. 4) is preset for providing an electric signal representative of detection of an error to CPU 61 through I/O 63 at an end of a predetermined timing interval. In this embodiment, the timing interval is set to be equal to or slightly longer than a time period necessary in the ink detection mode for passing one ink zone through the first and second detection positions or the printing position, namely, in the above-described assumption the time period necessary for passing the magenta ink zone 15B through the detection positions or the printing position. When ribbon winding motor 60 is energized for winding ribbon 11, CPU 61 supplies a signal to timer 90 through I/O 63 for setting the timer 90. At each time when timer 90 receives any color signal, i.e. yellow, magenta or cyan signal, from color identifying circuit 58 within the preset timing interval, it resets to start its timing operation again. For example, when ribbon winding motor 60 is energized to wind ribbon 11 after the printing of the cyan component is completed by the use of the cyan ink zone 15C which is immediately followed by the end portion 15D of ink ribbon 11, timer 90 sets according to the timer setting signal from CPU 61. Thereafter, when the end portion 15D of ink ribbon 11 comes below photosensors 19 and 21, light beams emitted from those photosensors 19 and 21 are reflected by a mirror plate (not shown), which is disposed just below ink ribbon 11, towards photosensors 19 and 21, which thus provide high signals to color identifying circuit 58. Hence no signal is supplied from color identifying circuit 58 to timer 90 for resetting the latter. At the end of the predetermined timing period, timer 90 thus trips and provides a signal representative of an error being detected in the ink ribbon 11 to CPU 61 through I/O 63. Such error information is displayed on a display device 85 such as CRT. Also during the printing the error signal from timer 90 is sent to CPU 61, but is disregarded.

Further, in the case where ink ribbon 11 is cut in two, the above-described color identifying circuit 58 can detect the error in the ink ribbon 11 since after one of the cut portions of the ink ribbon 11 is pulled by the rotation of ribbon winding reel 53 and passes below photosensors 19 and 21, no color signal is supplied to timer 90 for resetting, which causes timer 90 to provides an error signal to CPU 61 at the end of the preset timing period.

While the invention has been disclosed in specific detail for purposes of clarity and complete disclosure, the appended claims are intended to include within their meaning all modifications and changes that come within the true scope of the invention.

What is claimed is:

1. A method of detecting an error such as a cutoff or the like of an ink ribbon used in a thermal transfer type multicolor printer, wherein the ink ribbon is provided with sets of ink zones containing heat dissolving inks, each set of the ink zones including ink zones, disposed in a predetermined order, of different colors, comprising the steps of:

(a) presetting a timer for providing an electric signal representative of detection of the error at an end of a predetermined timing interval equal to a time period necessary in an ink detection mode, in which one of the ink zones having a specified color is detected, for passing at least one ink zone through a printing position where a multicolor printing is made by means of a thermal head;

(b) winding the ink ribbon at a predetermined speed in the ink detection mode;

(c) setting the timer at the winding of the ink ribbon;

(d) then, detecting a sensor mark, provided each of the ink zones for indicating its color, and thereby providing a color signal representative of the color indicated by the sensor mark;

(e) resetting the timer according to the color signal; and (f) providing the error detection signal at the end of the predetermined timing interval when no color signal is supplied to the timer within the timing interval.

2. A method as recited in claim 1, wherein the heat dissolving inks are light reflective inks, wherein the sensor mark is light absorbent and wherein the detecting step (d) further includes the steps of:

(g) projecting a light beam onto a sensing track on the ink ribbon, along which sensing track the sensor marks are disposed;

(h) receiving the light beam reflected from the light reflective ink zone (i) then, sensing the sensor mark when the reflected light beam is not received in the step (h).

3. An apparatus of detecting an error such as a cutoff or the like of an ink ribbon used in a thermal transfer type multicolor printer wherein: the ink ribbon is provided with sets of ink zones containing heat dissolving inks, each set of the ink zones including ink zones, disposed in a predetermined order, of different colors; and the ink ribbon is fed at a predetermined speed in an ink detection mode, in which one of the ink zones having a specified color is detected, by a ribbon winding motor, the motor rotating a ribbon winding reel on which the ink ribbon is wound, comprising:

(a) a sensor mark, provided to each of the ink zones, for indicating a color of each ink zone;

(b) a detector for detecting one sensor mark of one of the ink zones to thereby provide a signal representative of the one sensor mark, the one ink zone being in a printing position where the multicolor printing is performed;

(c) means, electrically connected to the detector, for identifying the color of the one ink zone according to the sensor mark signal from the detector to thereby supply a color signal representative of the one ink zone of the color being in the printing position;

(d) means for controlling the ribbon winding motor and providing an electric signal representative of the winding of the ribbon at the energization of the ribbon winding motor; and (e) a timer, connected to the color identifying means and the control means and presetable for providing an electric signal representative of detection of the error at an end of a predetermined timing interval equal to a time period necessary for feeding at least one ink zone, the timer being adapted to be reset according to the ribbon wining signal and the color signal.

* * * * *